US007178540B2

(12) United States Patent
Eder

(10) Patent No.: US 7,178,540 B2
(45) Date of Patent: Feb. 20, 2007

(54) CABANA CANOPY AND HUB

(76) Inventor: Fred Eder, 4212 Gulf Breeze Pkwy., Gulf Breeze, FL (US) 32563

( * ) Notice: Subject to any disclaimer, the term of this patent is extended or adjusted under 35 U.S.C. 154(b) by 151 days.

(21) Appl. No.: 10/897,237

(22) Filed: Jul. 22, 2004

(65) Prior Publication Data

US 2006/0102221 A1 May 18, 2006

(51) Int. Cl.
*E04H 15/36* (2006.01)

(52) U.S. Cl. ..... 135/133; 135/132; 135/135; 135/153; 403/170

(58) Field of Classification Search ..... 135/124, 135/132–133, 120.3, 135–136, 901, 906, 135/96, 152–153; 403/52, 62, 170
See application file for complete search history.

(56) References Cited

U.S. PATENT DOCUMENTS 2,969,075 A * 1/1961 Girten ..... 135/132
3,190,300 A * 6/1965 Wear ..... 135/126
4,355,650 A 10/1982 Beaudry
4,606,669 A 8/1986 DeBliquy
4,627,210 A 12/1986 Beaulieu
4,637,748 A 1/1987 Beavers
4,941,499 A * 7/1990 Pelsue et al. ..... 135/125
4,966,178 A 10/1990 Eichhorn
5,069,572 A 12/1991 Niksie
5,283,993 A * 2/1994 Sprung, Sr. ..... 52/64
5,544,671 A 8/1996 Phillips
5,655,559 A * 8/1997 Zembik et al. ..... 135/132
5,915,400 A 6/1999 Pohl et al.
6,021,795 A 2/2000 Long et al.
6,296,415 B1 * 10/2001 Johnson et al. ..... 403/170
6,475,117 B1 11/2002 Berglund et al.
6,591,571 B2 7/2003 Fritsche et al.
6,596,415 B2 7/2003 Shi et al.
2002/0059770 A1 5/2002 Fritsche et al.

* cited by examiner

*Primary Examiner*—Winnie Yip
(74) *Attorney, Agent, or Firm*—William H. Hollimon

(57) ABSTRACT

An improved personal shelter canopy hub is formed using a number of spherical rotating joint elements captured in a hub body. The joint elements provide rotational movement of canopy frame elements to allow easy opening and collapsing of a canopy frame and cover. An improved canopy includes two hubs joined by a cross shaft. Each hub may be formed by molding in high-density plastic and combined with stub arms to facilitate subsequent assembly of a completed canopy.

7 Claims, 5 Drawing Sheets

CABANA CANOPY AND HUB

BACKGROUND OF THE INVENTION

The present invention pertains to collapsible personal canopy shelters of typically light weight used as protection from wind or sun. In particular, the invention is such a shelter having unique frame hubs from which elongated frame elements extend radially and which allow both open and collapsed canopy conditions for ease of use, and portability. Such shelters are often referred to as "cabanas" and are employed typically in beach areas where sun and wind protection is often desired.

Similar cabana shelters are generally known in the prior art. For example, U.S. Pat. No. 4,355,650 to Beaudry discloses a typical prior art design for a personal shelter including a collapsible frame and a flexible cover. Beaudry discloses a frame formed of frame-like "bows" which pivot on a hub to alter the shape of an attached cover. However, the Beaudry hub design uses a cantilevered pivot design which is likely prone to failure and is susceptible to damage from sand during use.

SUMMARY OF THE INVENTION

The present invention is an improved cabana canopy and canopy hub. Generally "U" shaped canopy frame elements are attached at their ends to hubs of novel design. The novel hub enables coordinating the placement and movement of the canopy frame into open and collapsed conditions. The collapsed condition enables the canopy to be collapsed to a reduced-space geometry for more convenient portability and storage. The hub design uses large joint knuckle elements with relatively large bearing surface area to reduce susceptibility to damage from sand.

The hub consists of a hub body in which multiple joint knuckle elements are retained. Each joint knuckle is locationally captured yet allowed to rotate to allow movement of attached frame elements. Each joint knuckle is preferably shaped generally as a sphere and is received in a curved depression in the hub body. This geometry provides the large bearing surface desired in operation. Both the hub body and the joint knuckle are most advantageously formed of molded rigid structural plastic that, in combination with the joint knuckle design, provide a durable canopy hub and canopy for use in outdoor locations.

In one embodiment, each hub may be precombined with shortened stub arms secured to the joint knuckles. This assembly may then be advantageously combined with canopy frame elements, to form a finished canopy in a simplified process. In this embodiment, the stub arms preferably take the form of wooden dowels which slide into metal tubing frame elements of the canopy.

Additional elements and advantages of the invention are illustrated in the following description of preferred embodiments and the accompanying illustrations.

DESCRIPTION OF THE PREFERRED EMBODIMENTS

Figure 1B:
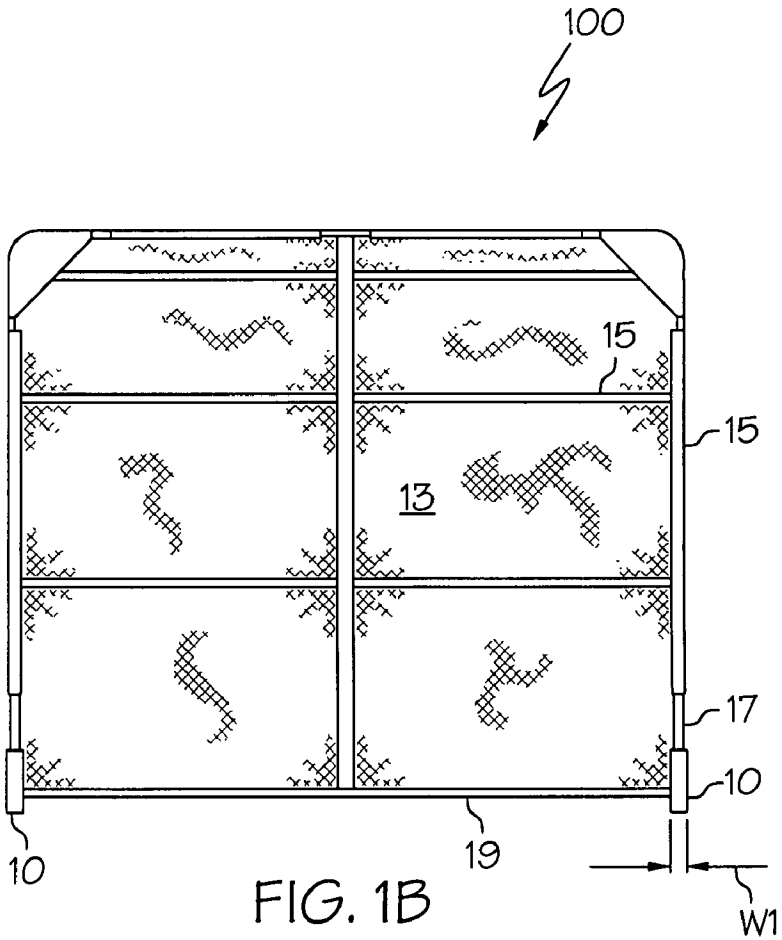
FIGS. 1*a* and 1*b* are, respectively, side and front views of a cabana canopy according to the invention in a configuration for use as a shelter, and including the present inventive canopy frame hubs.
Figure 1A:
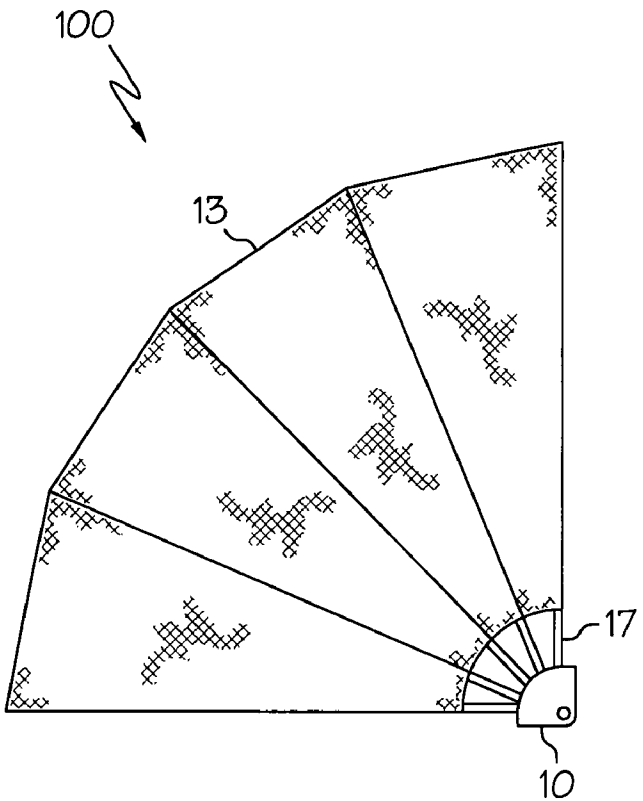

FIGS. 1*a* and 1*b* are, respectively, side and front views of a cabana canopy 100 according to the invention in a configuration for use as a personal shelter, and including two inventive canopy frame hubs 10. The canopy 100 includes a cover 13 supported by generally "U" shaped frame elements 15 in the manner of many canopies in the prior art. The cover 13 is formed of a flexible sheet material such as cloth, canvas, rubberized cloth or plastic sheeting. The frame elements 15 are relatively rigid elongated structures, preferably formed of bent hollow metal tubing, such as aluminum tubing. In the prior art, bent or joined wood frame elements are also taught for such use. The frame elements 15 are dispersed over, and attached to, the cover 13 such that when separated, the frame elements 15 expand or stretch the cover 13 to create an open-faced shelter as shown in the figure. To provide a more compact collapsed configuration of the canopy, for portability and convenient storage, the frame elements 15 may all be gathered together in side-by-side stacked fashion, while the cover 13 is folded between. In the embodiment shown, there are five frame elements 15, although other numbers may be similarly employed. At least two are necessary to stretch and open the cover 13.

To enable the movement of the frame elements 15 between the separated condition (canopy as a shelter) and the collapsed condition (see FIG. 4—for portability or storage), the frame elements 15 each have terminal ends 17 which are connected on opposite sides of the canopy to a respective hub 10. Each hub 10 rotatably retains the frame element ends 17, and guides their movement to, alternatively, smoothly open and stretch the cover 13, or collapse the canopy. The terminal ends 17 may be integral with the frame elements 15 or attached extensions thereof of like or distinct material and construction.

The two canopy hubs 10 are preferably connected along a common axis by a rigid cross bar 19. In this manner, each frame element's respective ends 17 are induced to move in coordinated fashion and prevent binding. This geometry is discussed in more detail below. The cross bar 19 need not provide complete torsional rigidity between the hubs 10 but rather limit angular displacement between the two sides.

Figure 2A:
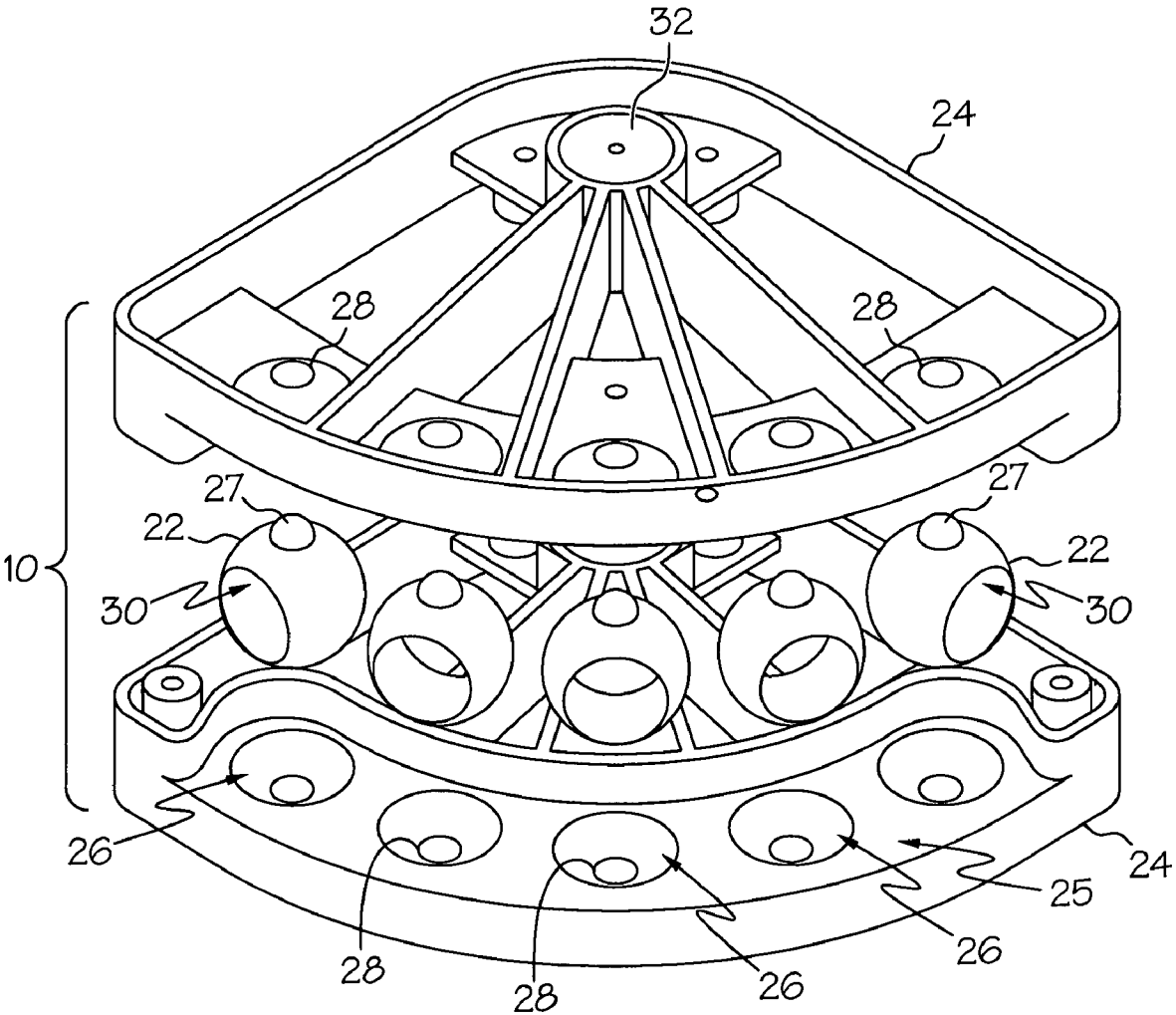
FIGS. 2*a* and 2*b* are exploded isometric and side views, respectively, of the inventive cabana canopy frame hub.
Figure 2B:
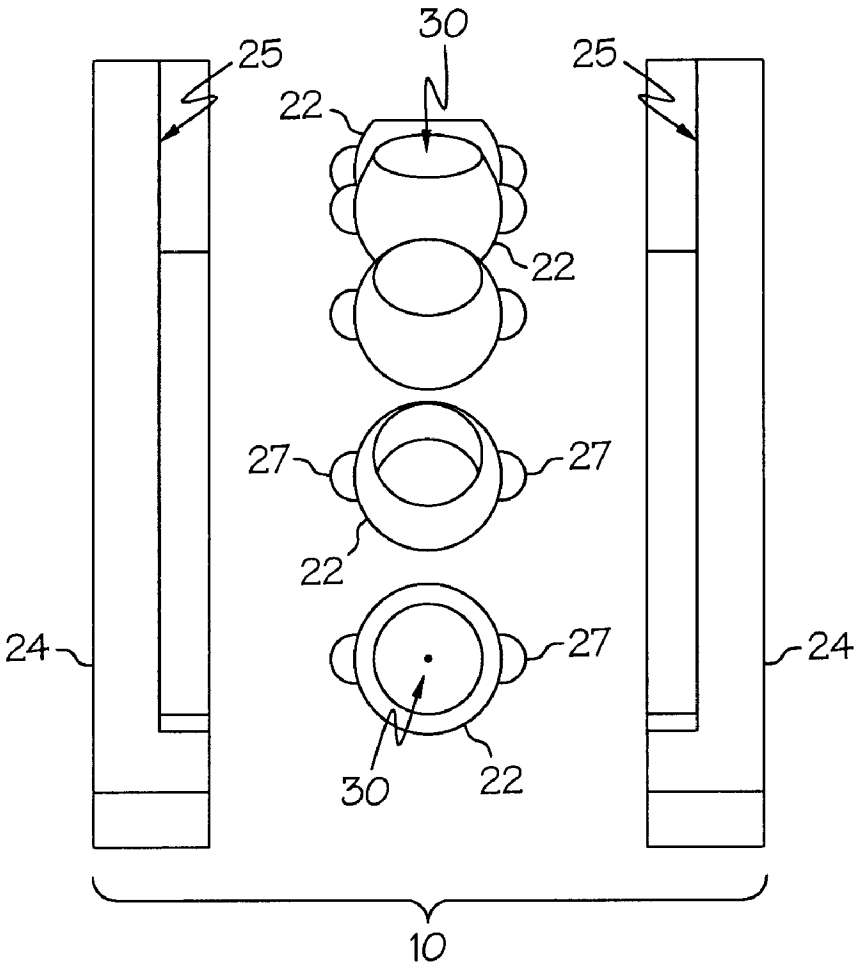

FIGS. 2*a* and 2*b* are exploded isometric and side views, respectively, of a preferred embodiment of the inventive cabana canopy frame hub 10. The hub 10 is formed of rigid hub side portions 24 which, when joined, capture and retain, in fixed relative positions, multiple rotational joint knuckles 22. The joint knuckles 22 are retained in a common plane and each has a rotation axis perpendicular to the plane. Consequently, the axes are mutually parallel. This geometry enables the function of the joint knuckles 22 of positioning and coordinating the canopy frame ends 17 as discussed above. Each joint knuckle 22 in the figures is shown in a different angular orientation.

In the embodiment shown in FIGS. 2*a*, 2*b*, the hub 10 is preferably formed of two mating hub sides 24. The hub sides 24 are preferably identical in order to simplify, and reduce cost of, manufacture. Both hub sides 24 have a stepped internal face 25 in which are formed a number of round depressions 26, each shaped to receive, in a loose fit, a respective joint knuckle 22. The hub sides 24 are configured such that when joined to form the assembled hub, the stepped faces 25 are aligned but separated to allow the joint knuckles 22 to be received between the hub sides 24, and captured in the respective aligned and facing depressions 26. The aligned and facing depressions 26, create a plurality of spherical receiving spaces for receiving each respective joint knuckle 22. Because the stepped faces 25 extend to the exterior of the hub, they form a slot in the hub from which frame ends 17, secured in the joint knuckles 22, may extend (see FIGS. 3, 4). Preferably, the joint knuckles 22 are generally spherical in shape with the depressions having matching shape. The hub sides 24 may be cojoined via threaded fasteners or other means.

Preferably, each joint knuckle 22 has a pair of stub shafts 27 extending from opposite sides of the joint knuckle 22. These are sized to be received in through-holes 28 extending through the middle of depressions 26. Both the stub shafts 27 and through-holes 28 are aligned with the axis of rotation of the joint knuckles 22 and act to stabilize and direct the rotation of the joint knuckles—and attached frame elements. Because little force is exerted on the joint knuckle in their intended use, the stub shafts 27 need be little more that reduced-diameter half-sphere projections on the outer surface of the joint knuckles 22.

In one embodiment, each joint knuckle 22 has a cylindrical cavity 30 perpendicular to its axis of rotation and passing through its center. The inside diameter of the joint cavity 30 is sized to accept a frame end 17 (not shown—see FIG. 1) or other element to connect with the frame end 17. Although the cavity 30 may be a through-hole, a blind end bore is preferred. Although in this embodiment the cavity 30 is cylindrical, other cavity geometries may be used, e.g., square or rectangular cross sections. Each joint knuckle 22 is preferably formed of molded high density plastic with integral molded stub shafts, although metals or other structural material may also be used.

The hub sides 24 are preferably formed of a molded high-density plastic with an open, relatively thin-walled, construction using intercostals to interconnect the hub portion containing the stepped face 25 and the other portions of the hub. In the construction shown in the figure, intercostals rigidly connect the stepped face 25 with a hub portion including a cross bar bore 32. The axis of the cross bar bore 32 is perpendicular to the plane of the stepped face 25, and therefore also to the plane of the retained assembled joint knuckles 22. The cross bar bore 32 is sized to accept a cross bar 19 to form the configuration shown in FIG. 1*b*. In final assembly and use the cross bar 19 (see FIG. 1) is preferably permanently fixed in the cross bar bore 32. Other alternative construction designs and methods are contemplated to also satisfy the functions detailed herein.

The depressions 26 (and retained joint knuckles 22) are preferably located on the stepped face 25 in an approximate circular pattern with respect to the cross bar bore centerline. In the embodiment shown, they range through an angular dimension of preferably at least 90 degrees of arc with respect to the cross bar bore 32. The exterior, outwardly facing surface of the hub adjacent to, and bounding, the stepped face is preferably curved as shown, although this shape is not critical.

Figure 3:
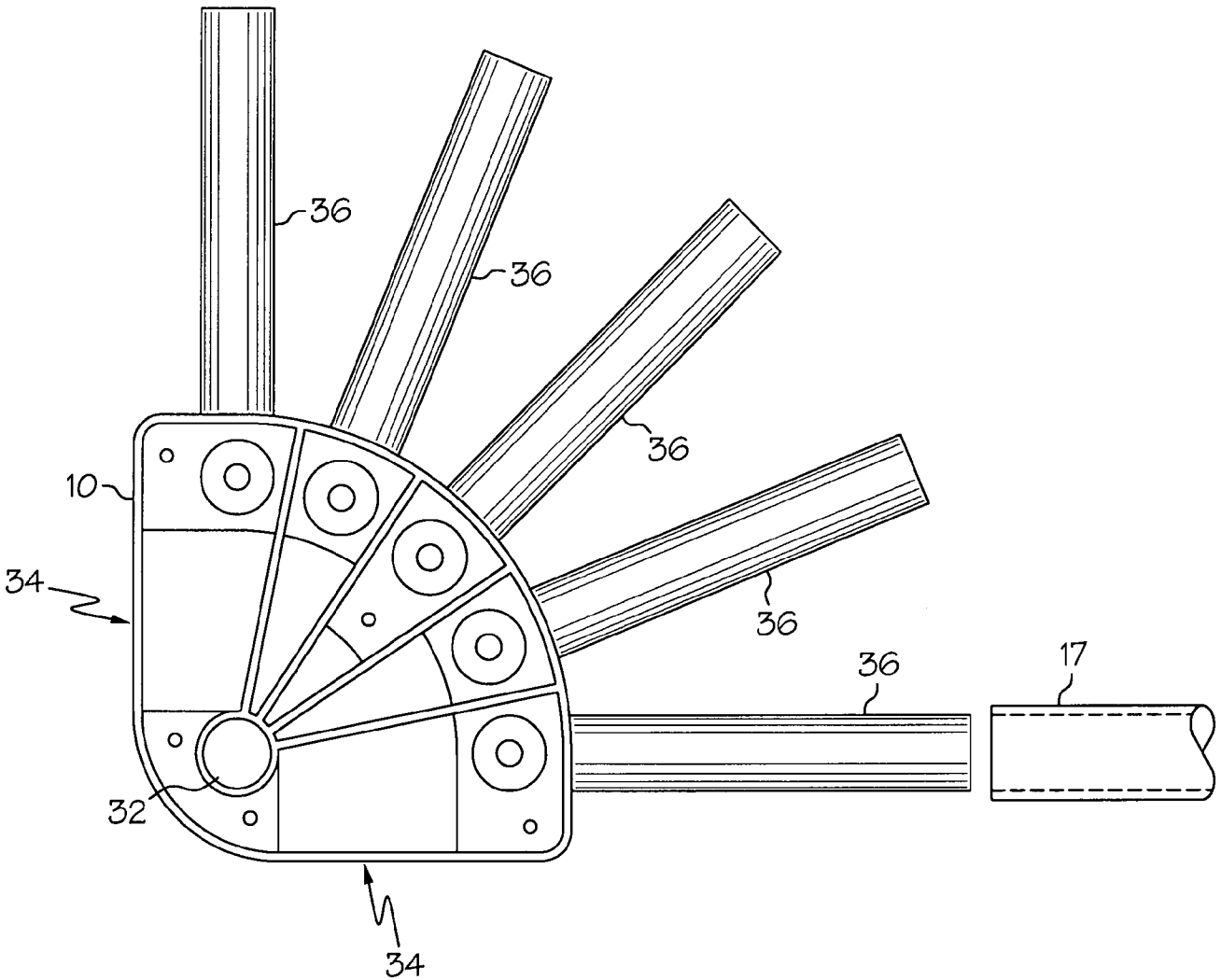
FIG. 3 is a side view of the inventive hub including stub terminal end arms in an opened condition with the terminal end arms separated for an opened canopy.
Figure 4:
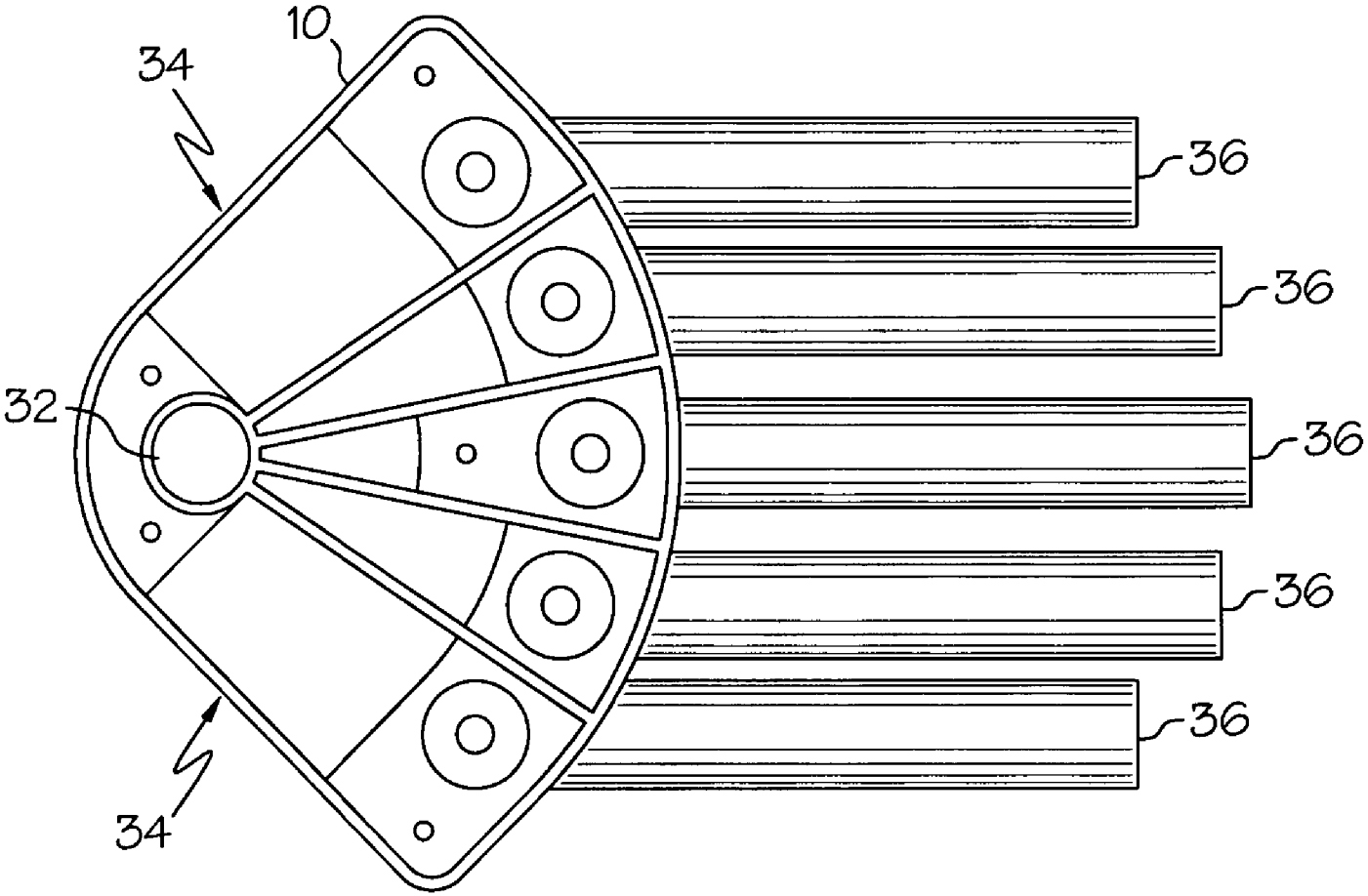
FIG. 4 is a side view of the device of FIG. 3 showing the stub terminal ends arms in a collapsed condition.

FIGS. 3 and 4 depict an embodiment of the inventive hub 10 including stub arms 36 connected to the joint knuckles as shown in FIG. 2*a* (not visible in FIGS. 3, 4). The hub 10 has a pair of exterior and outward facing bearing surfaces 34. The bearing surfaces 34 are preferably both relatively flat and parallel to the cross bar bore centerline. The angle between the two bearing surfaces is preferably approximately 90 degrees. The junction of the two bearing surfaces 34 is preferably rounded, preferably at a radius of curvature of 1.5 inches (3.8 cm) or more. This geometry enables the hubs 10 of a canopy 100, assembled in embodiments as shown in FIG. 1, to be rotated about the cross bar 19 to orient the canopy 100 in relatively opposite directions on the ground. This can be conveniently accomplished by the user, by rotating the entire canopy assembly, without lifting its entire weight, on the bearing surfaces 34 and their rounded junction. The width W1 (FIG. 1) of each hub 10, across the bearing surfaces, should be sufficient to "float" the canopy on beach sand. A hub width W1 of two inches (5 cm) has been found to be satisfactory. This width also provides sufficient dimension to envelope a preferred construction of the stepped face and joint knuckles.

In FIGS. 3 and 4, the joint knuckles (not visible) are joined to stub arms 36 rather than directly to canopy frame terminal ends. This structure facilitates canopy manufacture and assembly. The stub arms 36 are preferably round wood dowels, of relatively short length, which are permanently secured within respective joint knuckle cavities. They are fixed there preferably by adhesive, but alternatively by fasteners. This operation can be accomplished prior to the assembly of the joint knuckles into a hub body. This results in the hub assembly shown including the attached stub arms 36. This assembly can then be joined with a canopy frame formed of (for example) hollow tubing by inserting the stub arms 36 into the terminal ends of the tubing. The stub arms 36 may also be considered as forming the terminal ends 17 upon assembly into a canopy. This mode of construction is simple and modular and has cost benefits which will be obvious to one skill in manufacture of products of this nature.

FIGS. 3 and 4 depict open and collapsed conditions, respectively, of the stub arms 36. The open condition enables a fully opened canopy with the canopy frame opened at a quarter circle (90 degree) configuration as shown in FIG. 1. The collapsed condition enables the canopy to be collapsed to a reduced-space geometry for more convenient portability and storage. In the open condition, the stub arms are separated to their greatest angular extent in an open fan shape with the outermost stub arms at a respective angle of at least 90 degree. In the collapsed condition, as shown in FIG. 4, the stub arms 36 may be oriented in substantially mutually parallel fashion for compaction of the frame and canopy 100. These conditions apply also in embodiments in which the joint knuckles 22 are connected directly to the canopy frame terminal ends 17. The spacing and size of the joint knuckles and stub arms (or terminal ends) should accommodate both these conditions.

In a prototype device following the construction shown in the embodiments of FIGS. 2*a*, 2*b* and 3, five stub arms 36, having a cross-sectional diameter of ⅞ inches (2.2 cm) and a length of 12 inches (30.5 cm), are each secured in matching joint knuckles. The outside diameter of spherical joint knuckles is about ¼ inches (3.2 cm). The five joint knuckles are spaced over 90 degrees of arc—a 22.5 degree interspacing. The radial dimension from the center bore centerline to each joint knuckle centerline of rotation is 3.9 inches (9.9 cm). The slot created by the offset stepped faces of the facing hub sides is slightly wider than the stub arm diameter. This geometry allows the stub arms to swing freely between the open (90 degree) and collapsed (mutually parallel) conditions described above.

The preceding embodiments and discussions are provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A collapsible personal canopy hub comprising:

a hub body; and a plurality of joint knuckles, each joint knuckle secured to the hub body in a common joint plane, each joint knuckle rotatable about a respective joint rotation axis and all rotation axes perpendicular to the joint plane, and each joint knuckle having a cavity configured to receive a shaft, each cavity having a longitudinal central axis perpendicular to the respective joint rotation axis.

2. A collapsible personal canopy hub, according to claim 1, and wherein:

each joint knuckle further includes at least one stub shaft extending radially from a periphery of each joint knuckle and aligned with each joint knuckle's rotation axis.

3. A collapsible personal canopy hub comprising:

a hub body;

a plurality of joint knuckles, each joint knuckle secured within the hub body in a common joint plane, each joint knuckle rotatable about a respective joint rotation axis and all rotation axes perpendicular to the joint plane, and each joint knuckle having a cavity configured to receive a shaft, each cavity having a longitudinal central axis perpendicular to the respective joint rotation axis; and securing means for securing a cross bar to the hub body perpendicular to the joint plane.

4. A collapsible personal canopy hub, according to claim 3, and wherein each joint knuckle has a spherical outer shape; and the hub body has a plurality of spherical receiving spaces, each spherical receiving space receiving a respective joint knuckle.

5. A collapsible personal canopy hub, according to claim 3, and wherein:

a respective shaft is received in each joint knuckle cavity and extends therefrom; and the hub having at least a first condition in which the shafts are all coplanar and substantially parallel and a second condition in which the shafts are coplanar and angularly disbursed in a 90 degree fan configuration.

6. A collapsible personal canopy, comprising:

a plurality of elongated U-shaped frame elements, each frame element having a first and second terminal end;

a flexible canopy cover attached to the frame elements;

an elongated cross bar having a first and second end;

a first hub and a second hub connected, respectively, to the cross bar first and second ends; and each hub comprising:

a hub body;

a plurality of joint knuckles, each joint knuckle secured within the hub body, and each joint knuckle rotatable about a respective joint rotation axis and all rotation axes parallel to the cross bar; and each first hub joint knuckle secured to a respective frame element first terminal end; and each second hub joint knuckle secured to a respective frame element second terminal end; and wherein: the canopy is configured to form at least a first condition in which the frame elements are all substantially parallel and a second condition in which the frame elements are angularly disbursed in a 90 degree fan configuration.

7. A collapsible personal canopy, according to claim 6, and wherein: each joint knuckle has a spherical outer shape; and each hub body has a plurality of spherical receiving spaces, and each spherical receiving space receives a respective joint knuckle.

* * * * *